United States Patent [19]

Hallström

[11] 4,440,360

[45] Apr. 3, 1984

[54] EXTENDABLE FIN

[75] Inventor: Stig Hallström, Karlskoga, Sweden

[73] Assignee: Aktiebolaget Bofors, Bofors, Sweden

[21] Appl. No.: 459,163

[22] Filed: Jan. 19, 1983

Related U.S. Application Data

[63] Continuation of Ser. No. 195,165, Oct. 8, 1980, abandoned.

[30] Foreign Application Priority Data

Oct. 9, 1979 [SE] Sweden ..... 7908358

[51] Int. Cl.[3] ..... F42B 13/32

[52] U.S. Cl. ..... 244/3.28; 244/3.24; 244/49

[58] Field of Search ..... 244/3.24–3.29, 244/46–49

[56] References Cited

U.S. PATENT DOCUMENTS

| | | | |
|---|---|---|---|
| 1,166,879 | 1/1916 | Alard | 244/3.29 |
| 1,339,188 | 5/1920 | Frecska | 244/3.27 |
| 3,627,233 | 12/1971 | Jacobson et al. | 244/3.27 |
| 3,819,132 | 6/1974 | Rusbach | 244/3.28 |
| 3,990,656 | 11/1976 | Minnich | 244/3.27 |
| 4,209,146 | 6/1980 | Mattson | 244/3.27 |
| 4,209,147 | 6/1980 | Jones, Jr. | 244/3.28 |

FOREIGN PATENT DOCUMENTS

| | | | |
|---|---|---|---|
| 788868 | 7/1968 | Canada | 244/3.28 |
| 2365776 | 5/1978 | France | 244/3.28 |
| 560931 | 4/1944 | United Kingdom | 244/3.24 |

*Primary Examiner*—Harold J. Tudor

*Attorney, Agent, or Firm*—Pollock, Vande Sande & Priddy

[57] ABSTRACT

In an ammunition unit in the form of a shell (1), projectile or the like which is fin-stabilized, an extendable fin is utilized which is intended to be retracted during firing in a barrel or the like and to be extended as soon as the shell or the like has left the barrel. The extendable fin is intended to increase the stability of the ammunition unit in the ballistic trajectory. The extendable fin consists of two fin parts (4' and 4'') supported separately in relation to each other and which in their extended positions are joined together and form the fin.

10 Claims, 5 Drawing Figures

EXTENDABLE FIN

This is a continuation of application Ser. No. 195,165 filed Oct. 8, 1980, now abandoned.

TECHNICAL FIELD

The present invention relates to an extendable fin for a fin-stabilized ammunition unit in the form of a shell, projectile, or the like, which may be fired from a gun, mortar, or the like.

BACKGROUND ART

Extendable fins on ammunition facilitate firing, at the same time increasing the stability of the shell in its ballistic trajectory, and therefore the range and probability of hitting.

Extendable fins are previously well known. Thus, for example, a narrow groove in a main fin or the body of the unit, is arranged a spring fin which is supported at its front end, and which when spread springs forth with its rear parts above the main fin or the envelope surface of the unit so that it inclines obliquely outwards and rearwards.

DISCLOSURE OF INVENTION

Technical Problem

The increased stabilizing effect obtained from the spring fin is determined by the design of the spring fin, and it is desirable to have a comparatively large spring fin area over the main fin or the envelope surface, which should also have a certain, predetermined form.

For want of space, however, there are difficulties involved in obtaining the desired configurations with the previously known spring fins. If, for instance, the previously known spring fin supported at its front end is utilized, this fin has an elongate form which involves an increased degree of spreading which does not give any substantial improvement of the stability of the shell.

The Solution

The extendable fin according to the present invention solves the above-mentioned problems, and a fin is proposed which uses the same space for the extendable fin as previously and substantially increases the stability of the shell.

The feature that characterizes the new extendable fin is that it comprises two fin parts which are supported separately in relation to each other. In their extended position they are joined together to form the fin.

In further developments of the invention more detailed proposals are given for the positioning of the fin parts in the shell and how these should be designed in order that distinct extension positions are obtained, which are substantially independent of the decrease in acceleration and rotation which takes place in the ballistic trajectory of the ammunition unit.

However, the feature that can mainly be considered to be characteristic for an extendable fin according to the invention will be noted from the claims.

Advantages

Through the invention it is possible, utilizing the same space as has previously been used for the previously known spring fin, to substantially increase the stability of the ammunition unit. The fin in its extended position becomes more effective and provides a substantially increased distance between the centre of gravity Tp of the shell and the centre of pressure Tc compared with what has previously been obtained.

In the aforesaid further developments extendable fins which functionally are obtained, in practice, notwithstanding a simple design. It is also be possible, in a simple way, to obtain distinct spreading positions of the fin in question, although a special spring for the spreading function, which is awkward from the point of handling, can be avoided.

BRIEF DESCRIPTION OF DRAWINGS

An embodiment according to the invention will be described in the following with reference to the accompanying drawings, in which.

BEST MODE OF CARRYING OUT THE INVENTION

Figure 1:
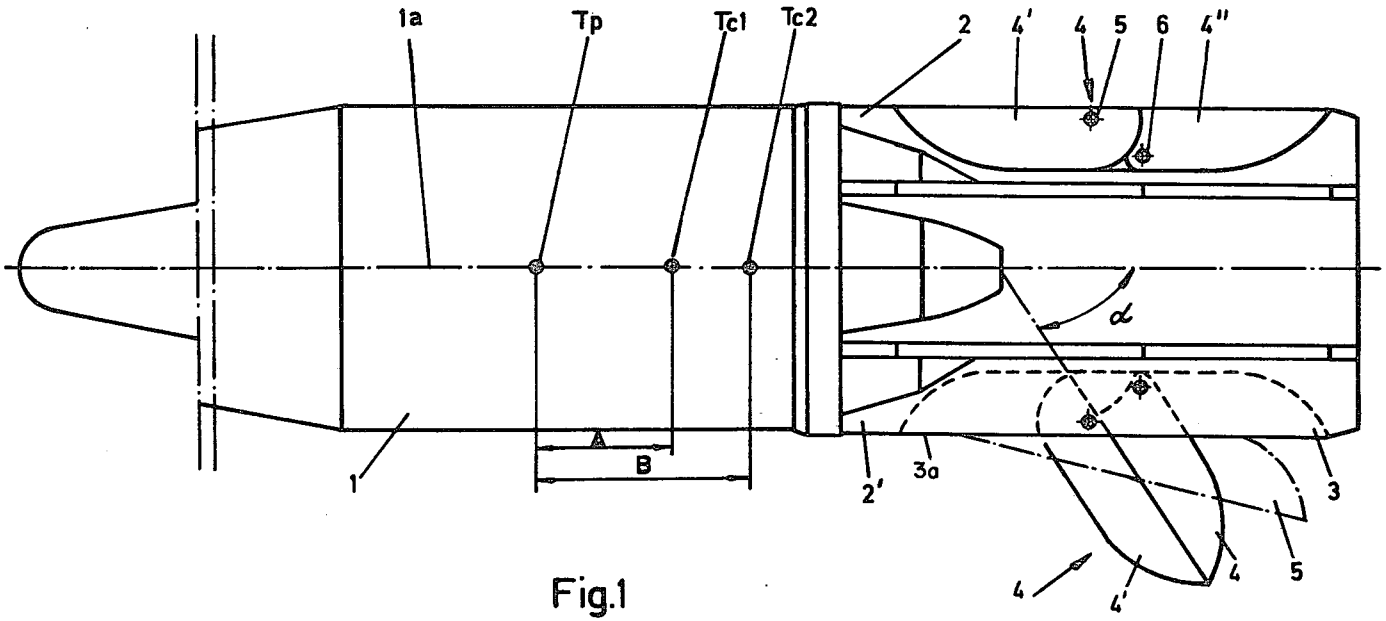
FIG. 1 shows a projectile which is provided with the new extendable fin (solid lines), and also with a previously known spring fin (dot-dash lines), FIG. 2 in cross-section and enlarged in relation to FIG. 1 shows a first embodiment of the new extendable fin in its retracted position.

FIG. 1 is intended to show a fin-stabilized shell 1, which is known in itself, which can utilize the extendable fin according to the invention. In the figure, the position of the center of gravity of the shell has been indicated by Tp. Further, two positions of the center of pressure of the shell have been indicated by Tc1 and Tc2. Tc1 indicates the position obtained with the previously known spring fin and Tc2 indicating the position that can be obtained with the new extendable fin. The distance between Tp and Tc is essential to the stability of the shell, and the greater the distance, the greater the stability. At tests which have been made, it has been established that the earlier distance A has been approx. 45 mm, while the distance B can now be increased to approx. 70 mm.

The shell is provided with a fin assembly consisting of main fins 2 and in these, in grooves 3 which emerge at the upper edges 2*a*, extendable auxiliary fins or so-called spring fins 4 are placed. In a way which is known in itself, each main fin is provided with an auxiliary fin 4.

The new extendable fin comprises two fin parts 4' and 4'' which are supported separately in relation to each other, each on its journal support 5 and 6, respectively, which are well known in themselves, and comprise a journal fastened in two opposite walls, and on which the respective fin part is rotatably supported.

The fin parts 4' and 4'' are shown in their retracted positions—see the fin parts for the upper main fin 2 in the figure—and also in their extended positions—see the fin parts for the lower main fin 2' in FIG. 1.

In FIG. 1, a spring fin 5 of a previously known type has also been indicated.

In their extended positions, the fin parts 4' and 4'' give rise to the center of pressure Tc2, while the spring fins 5 in their extended positions give rise to the center of pressure Tc1. The new fin parts 4' and 4'' are placed in the same space as a spring fin 5' which for its extending function also requires an extending spring, not shown, and which thus is not needed for the new extendable fin.

Figure 2:
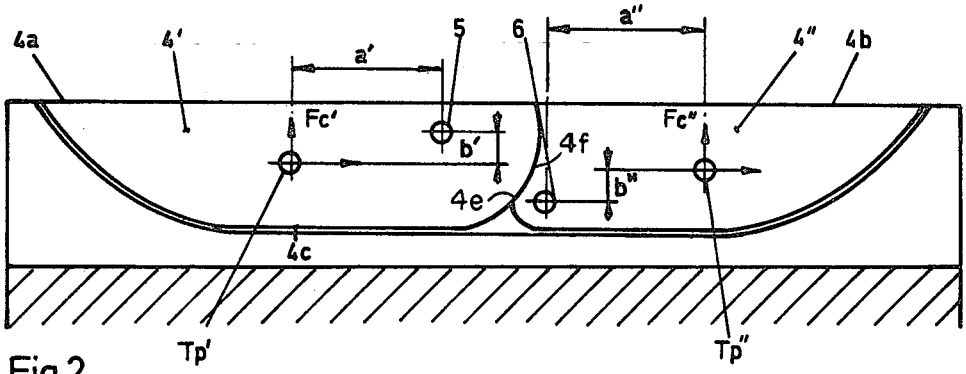
Figure 3:
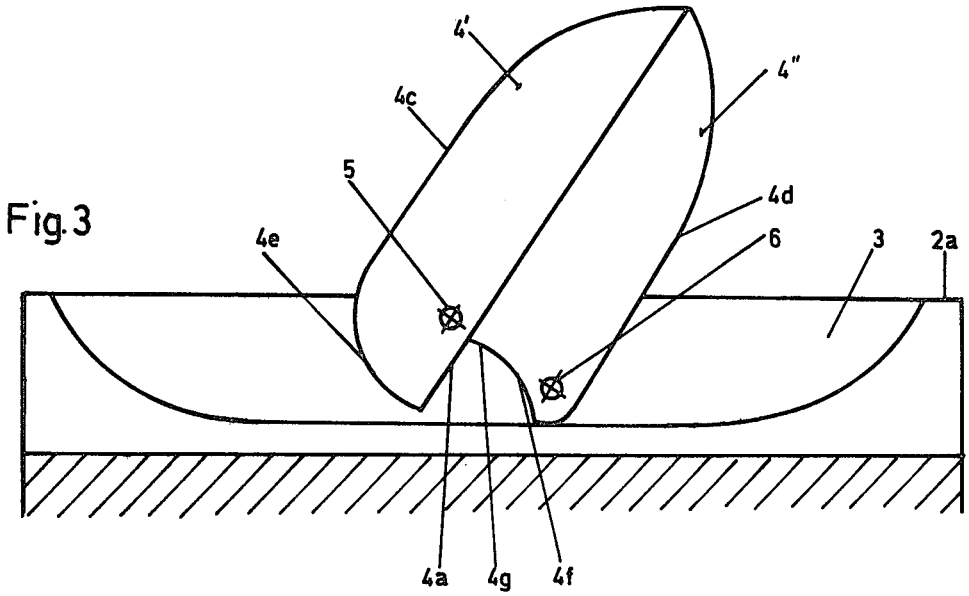
FIG. 3 shows in cross-section the fin according to FIG. 2 in its extended position, FIG. 4 in cross-section shows a second embodiment of the new fin in its retracted position.

FIGS. 2 and 3 are intended to show a first embodiment of the fin parts 4' and 4" in more detail. The fin parts have straight upper edges 4a and 4b, respectively. Also a part of the lower edge 4c and 4d, respectively, is straight, but at the end of the respective fin part which is not supported, the lower edge is curved so that it has a tapering free end.

The first fin part 4' has a convex rear edge 4e which in the retracted position of the fin part is in coaction with a concave corresponding end surface 4f on the second fin part 4". In the lower corner of the second fin part the concave surface is transformed into a pronounced corner section, which will be eccentrically arranged in relation to the supporting axle 6. The fin parts are sheet formed and have a thickness of approx. 2 mm, and the groove 3 in which the fin parts are placed is somewhat wider. The fin parts are made of some appropriate metal alloy. The first fin part can have a mass of approx. 16 kg and the second fin part a mass of approx. 13 g. The location of the centre of gravity in the first fin part is indicated by Tp' and the corresponding position of the centre of gravity of the second fin part by Tp". In the figure, the centrifugal force acting upon the fin part is indicated by Fc' and Fc", which force forms moments with the distance a' and a" respectively. The acceleration of the shell causes an acceleration force on the respective fin part which forms moments with the distance b' and b", respectively. At a rotation of approx. 3500 r.p.m. and an acceleration of approx. 3560 g, said distances can be chosen as follows: a'=24.5 mm, a"=26.8 mm, b'=5.4 mm and b"=6.5 mm, which for the first fin part gives an acceleration moment of 30.5 kpcm and Fc' a moment of 28.2 kpcm, while the corresponding values for the second fin part will be 24.8 kpcm and 22.9 kpcm, respectively.

During the firing in the barrel of a gun, the fin parts are retracted according to FIG. 2, the first fin part then locking the second fin part, because of the convex fin parts and concave rear edges 4e and 4f, respectively. The first fin part is kept pressed in through coaction with the gun barrel.

As soon as the shell has left the barrel, the first fin part is released, and its moment Fc'×a' forces the first fin part out to the extended position. The second fin part is then released and is forced out to its extended position by the moment Fc"×a". Further, the corner section 4g goes into coaction with the surface 4a by the corner being arranged eccentrically in relation to the supporting axle 6. The coaction between the corner 4g and the surface 4a defines the spreading angle in relation to the longitudinal axis 1a of the projectile (see FIG. 1). The thus locked second fin part also determines the position of the first fin part which is freely supported on the supporting journal 5. The supporting journal 5 and the center of gravity Tp' are then chosen in such a way that in its extended position the first fin part, by the acceleration moment, strives to be turned further rearwards from the extended position thus achieved against the influence of the locking function for the second fin part. The two fin parts will thus be in contact with each other via the straight upper end edges 4a and 4b, respectively. The moment chosen for the centrifugal force on the second fin part is then chosen so that it will be certain that the second fin part is held out in spite of the acceleration moments in the first and second fin parts. A condition for the above is, that the supporting point 6 for the second fin part is farther in towards the center line 1a of the projectile than the supporting point 5.

The fin parts thus extended form a configuration above the upper edge 3a of the main fin which is effective for the stabilization of the shell. The wide (2 times the width of the respective fin part, i.e. twice as wide as previously) and the comparatively short fin is entirely superior to the fin configuration above the edge 2a which is obtained with the spring fin 5 (FIG. 1). It has been proved that a greater degree of extension for the fin 5 than shown in FIG. 1 gives only an insignificant increase of the stability of the shell, and it has therefore not been possible to use this way of increasing the stability.

Figure 4:
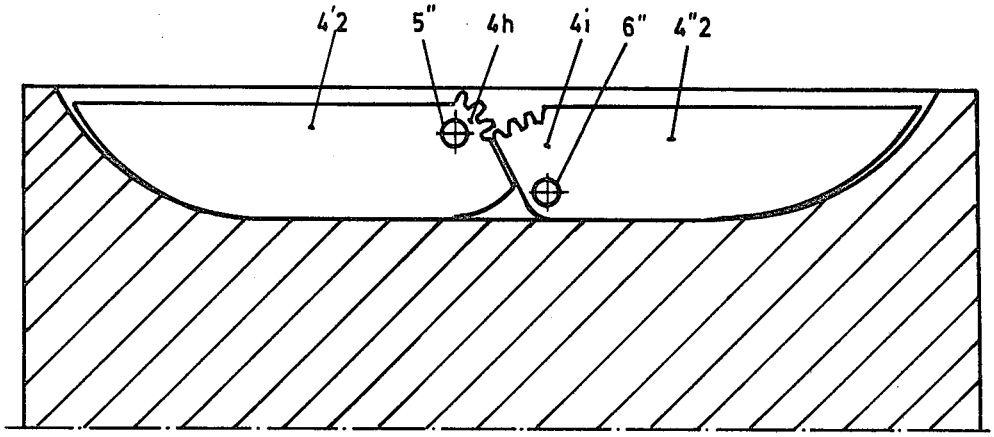
Figure 5:
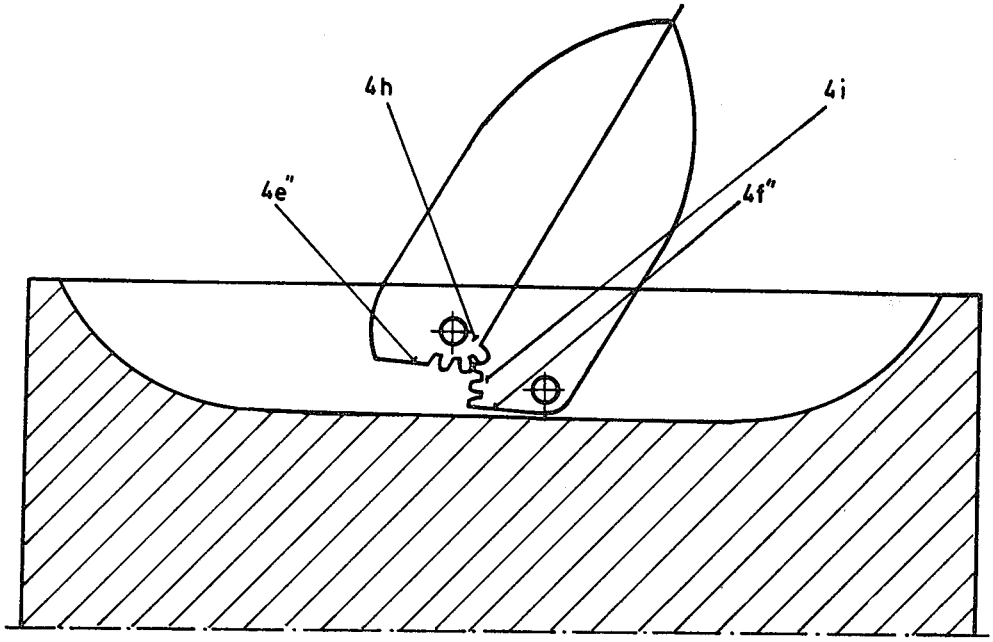
FIG. 5 shows in cross-section the fin according to FIG. 4 in its extended position.

In the embodiment according to FIGS. 4 and 5, gear arcs 4h and 4i, respectively, have been arranged at the rear edges of the fin parts, and are located at the upper, rear corners of the fin parts. When the first fin part 4h, as above, is extended, the teeth on the two fin parts go into coaction with each other, and a co-ordinated extending function for the fin parts is obtained.

In the fully extended position, the teeth are still in mesh with each other, and the spreading positions of the fin parts will be less sensitive to decreases in the acceleration and/or rotation of the projectile.

Also in this embodiment, the positions of the rotating supports 5" and 6", and also the other moments and masses, are chosen in the same way as described above, and the function for the embodiment shown in FIGS. 4 and 5 is the same as described above.

The invention is not limited to the embodiments shown above as examples, but can be subject to modifications without departing from the scope of the invention as defined in the following claims.

INDUSTRIAL APPLICABILITY

The extendable fin proposed through the invention consists of parts of a simple design, which are easy to integrate in the ammunition for efficient ammunition production.

I claim:

1. In a fin stabilized ammunition unit including a projectile for firing into a trajectory, an improved stabilizing apparatus comprising:

a projectile housing having a fin carrying longitudinal groove;

first and second longitudinally extending planar fin parts, disposed within said groove, which have abutting ends, each mounted for rotation in a common plane containing a longitudinal axis of the projectile on separate pivot points adjacent said abutting ends in said groove, remaining free ends of said fin parts extending in opposite directions from said pivot points, said fin parts having complementary surface portions which abut to form a single fin upon pivoting of said fin parts away from said groove in response to rotational acceleration of said projectile which forces said fin parts from said groove.

2. The stabilized ammunition unit of claim 1, wherein said fin parts have a longitudinal edge lying in a common plane when said parts are in a retracted position, said fin parts having abutting first ends which are curved, convex and concave, respectively, one of said curved ends including an abutment which limits the travel of said abutment carrying fin part when acceleration forces move said fin parts out from said groove.

3. The ammunition unit according to claim 2, where said part having said abutment limits the extent of travel of the other of said fin parts when said complementary surface portions abut.

4. The ammunition unit of claim 1 wherein said abutting fin parts ends include complementary gear teeth which synchronize movement of said fin parts, and maintain said fin parts in their extended positions during flight.

5. A fin stabilized ammunitions unit according to claim 1 wherein said first fin part includes means for keeping the second fin part locked in its retracted position.

6. A fin stabilized ammunitions unit according to claims 1 or 5, wherein the first fin part extends by a centrifugal force (Fc') owning to the rotation of the unit acting upon the first fin part and that while being extended it releases the second fin part which owing to said rotation fully extends.

7. A fin stabilized ammunition unit according to claim 6, wherein the second fin part includes means for cooperating with said first fin part for determining the degree of extension of the fin parts in relation to the longitudinal axis of the projectile.

8. A fin stabilized ammunition unit according to claim 1, wherein the fin parts are arranged in a groove particularly extending in the longitudinal direction of a main fin on the unit, said first and second fin parts being supported each with one end in a journal support.

9. In an ammunition unit of the type including a projectile for firing into a ballistic trajectory, a stabilizing apparatus comprising:

a projectile surface having a longitudinally extending groove; and first and second planar longitudinally extending fin parts having abutting ends, disposed within said groove, said fin parts connected to pivot into and out of said groove in a common plane, each of said fin parts having a first edge lying in the plane of said surface which upon rotational acceleration of said projectile pivot in opposite rotational directions until said first edges abut.

10. In an ammunition unit of the type including a projectile for firing into a ballistic trajectory, a stabilizing apparatus comprising:

a projectile surface having a longitudinally extending groove; and first and second planar longitudinally extending fin parts abutting along complementary curved end portions, said fin parts having a lower surface conforming with a bottom surface of said groove, and an upper surface coplanar with said projectile surface, said fin parts being pivoted on respective pivot points adjacent each abutting end to rotate in said groove in a common plane wherein said fin parts rotate only in response to rotational acceleration forces in opposite directions, one of said fin parts including an abutment which engages said bottom surface of said groove, to limit rotation thereof to a fixed position extending from said projectile surface, the remaining of said fin parts rotating until its upper surface abuts the abutment carrying fin part upper surface whereby a unitary extending fin is produced during acceleration.

* * * * *